US009004286B2

(12) United States Patent
Leal Filho et al.

(10) Patent No.: US 9,004,286 B2
(45) Date of Patent: Apr. 14, 2015

(54) PROCESS FOR CONCENTRATING MANGANESE ORES VIA REVERSE CATIONIC FLOTATION OF SILICATES

(71) Applicant: Vale S.A., Rio de Janeiro (BR)

(72) Inventors: Laurindo de Salles Leal Filho, Sao Paulo (BR); Helder Silva Souza, B. Buritis (BR); André Soares Braga, Sao Paulo (BR)

(73) Assignee: Vale S.A., Rio de Janeiro (BR)

( * ) Notice: Subject to any disclaimer, the term of this patent is extended or adjusted under 35 U.S.C. 154(b) by 0 days.

(21) Appl. No.: 14/172,672

(22) Filed: Feb. 4, 2014

(65) Prior Publication Data

US 2014/0216987 A1 Aug. 7, 2014

Related U.S. Application Data

(60) Provisional application No. 61/760,992, filed on Feb. 5, 2013.

(51) Int. Cl.

| | |
|---|---|
| ***B03D 1/02*** | (2006.01) |
| ***B03B 7/00*** | (2006.01) |
| ***B03D 1/08*** | (2006.01) |

(52) U.S. Cl.
CPC *B03D 1/02* (2013.01); *B03D 1/085* (2013.01); *B03D 2203/04* (2013.01)

(58) Field of Classification Search
None
See application file for complete search history.

(56) References Cited

U.S. PATENT DOCUMENTS

| | | | | | |
|---|---|---|---|---|---|
| 2,231,265 | A | * | 2/1941 | Gaudin | 209/167 |
| 2,362,432 | A | * | 11/1944 | Cahn | 209/166 |
| 2,389,763 | A | * | 11/1945 | Cahn | 209/166 |
| 2,666,588 | A | * | 1/1954 | Schack et al. | 241/20 |

* cited by examiner

*Primary Examiner* — Thomas M Lithgow
(74) *Attorney, Agent, or Firm* — Arent Fox LLP

(57) ABSTRACT

A process for concentrating manganese from the tailing of a manganese-carrying mineral including removing a coarse particle size fraction from the tailing, desliming and conducting an acidic or a basic reverse cationic flotation. The manganese-carrying minerals are typically minerals with low manganese content from the lithologies "Tabular Pelite" (or PETB), Pelite Siltite (or PEST), Detritic (or DETR), Rich Pelite (or PERC) and Metallurgical Bioxide (or BXME). In another aspect, the present invention also relates to a reverse cationic flotation used to concentrate manganese which is carried out using depressor agents and collector agents as flotation reagents.

11 Claims, 9 Drawing Sheets

PROCESS FOR CONCENTRATING MANGANESE ORES VIA REVERSE CATIONIC FLOTATION OF SILICATES

CROSS-REFERENCE TO RELATED APPLICATION(S)

This application claims priority to U.S. Provisional Application No. 61/760,992 filed Feb. 5, 2013, which is incorporated herein in its entirety.

APPLICATION FIELD

The present invention relates to the field of mining. Specifically, the present invention relates to a process for concentrating manganese from tailings of a beneficiation plant.

BACKGROUND OF THE INVENTION

Manganese ore can be processed by crushing, classifying particle size and washing to remove a fine fraction, which is discarded as tailing. However, with the exhaustion of high grade manganese ore, mining industries face the challenge of benefiting and handling more complex ores and reprocessing tailings of high manganese content ores.

Usually manganese ores beneficiation flowcharts consist primarily of fragmentation and particle size classification, by exploiting only the richest and relatively coarse fractions, which are products that are called "granulated" and "sinter feed." The finer particle size fraction (below about 0.150 mm) is typically discarded as tailing for not being noble and also due to the fact that the current equipment/beneficiation operations are not suitable for the recovery of this finer particle size fraction.

The fine fractions which constitute the tailings of the current processing circuits and which are also derived from the lithologies "Tabular Pelite" (PETB), Pelite Siltite (PEST), Detritic (DETR), Rich Pelite (PERC) or Metallurgical Bioxide (BXME) are known for their low manganese content. According to the state of the art for the ores containing manganese a direct anionic flotation process is preferred for the recovery (and concentration) of manganese. Nevertheless, until now no results in terms of adequate manganese liberation can be identified encouraging the persistence in the use or development of this concentration route. In fact, the direct anionic flotation in basic medium of the manganese minerals was not successful. In this way, the need for a better manganese recovery (and concentration) process still remains in the current state of the art.

In this context it is desirable to develop alternative flowcharts and concentration routes for these wastes as a complement to current processes in order to increase the global recovery of manganese as well as to reduce the environmental impact of disposal of this finer particle size fraction.

SUMMARY OF THE INVENTION

According to the present invention, a new route of concentrating tailings from, for example, the Azul Mine is presented. This new route concentrates tailings through reverse flotation in pH greater than about 10, with a cationic collector and a polysaccharide, like Amide, as a depressor, with 20% solids, using stages of rougher, scavenger and cleaner flotation, the mineral-ore including manganese oxides (cryptomelane-holandite) and the gangue mineral including kaolinite.

This development of the present technology for concentrating fine manganese enables the processing of millions of tons of tailings that have been discharged by processing plants, and may prevent or reduce the continuation of such practice of discharging tailings in the future. In addition to enhanced production, the recovery of fine manganese also reduces the environmental impact of mining activity because it minimizes the disposal of waste.

The present invention relates to a process for concentrating manganese from the tailing of a beneficiation plant comprising: removing a coarse particle size fraction from the tailing, desliming and performing an acid or a basic reverse cationic flotation. The manganese-carrying minerals of the present invention are usually minerals with low manganese content and in one aspect being derived from the lithologies "Tabular Pelite" (or PETB), Pelite Siltite (or PEST), Detritic (or DETR), Rich Pelite (or PERC) and Metallurgical Bioxide (or BXME).

The present invention also relates to a reverse cationic flotation used to concentrate manganese which is floated using depressor agents and collector agents as flotation reagents.

DETAILED DESCRIPTION OF THE INVENTION

Figure 1:
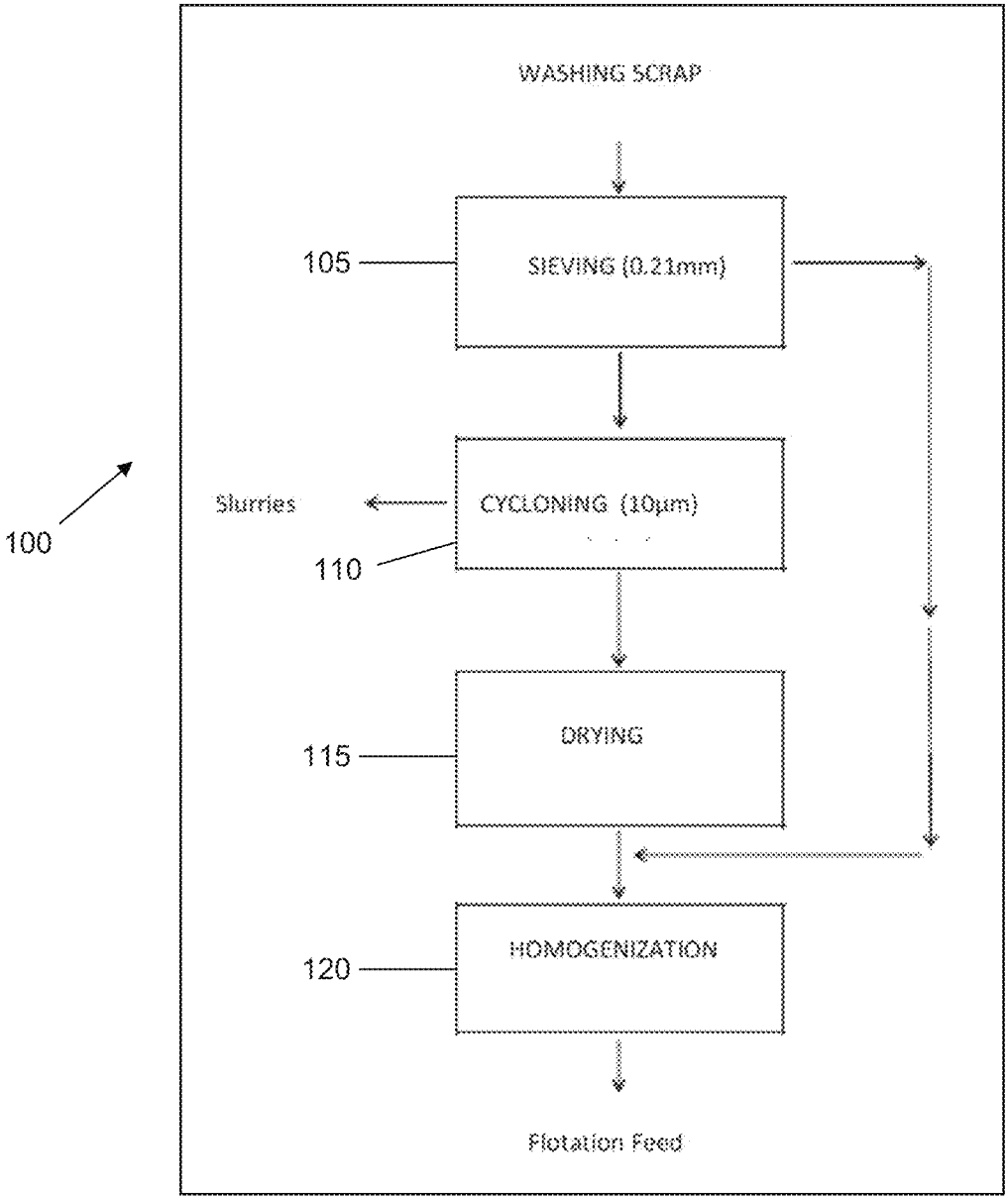
FIG. 1 is a generic flowchart of PETB processing

The present invention relates to a process for concentrating manganese from the tailing of a beneficiation plant.

In one aspect, the present invention provides a process to recover (and concentrate) manganese from the samples/lithologies called PETB, (PEST), (DETR), (PERC) and (BXME). The invention is designed to concentrate manganese-carrying minerals existing in the materials called PETB, (PEST), (DETR), (PERC) and (BXME).

When the industrial concentration circuit is fed by the lithologies "Tabular Pelite" (PETB), Pelite Siltite (PEST), Detritic (DETR), Rich Pelite (PERC) or Metallurgical Bioxide (BXME) fine fractions (tailings) are produced, which are also called PETB, (PEST), (DETR), (PERC) and (BXME), respectively. Therefore, PETB, (PEST), (DETR), (PERC) and (BXME) should be understood herein with the aim of identifying the fine fractions which constitutes the tailings of the current processing circuits and which is also derived from the lithology of the same name.

In one aspect, the present invention concentrates manganese minerals existing in the materials called PETB, (PEST), (DETR), (PERC) and (BXME) using a different route than typical processing, a concentration process by flotation, but surprisingly using reverse cationic flotation of gangue in basic or acid media. Through this process, instead of floating the manganese-containing ores, kaolinite, the main contaminant mineral is floated, the manganese being concentrated and recovered at the sunken products of the flotation process.

The manganese minerals of the present invention are usually minerals with low manganese content.

The process of the present invention is generally characterized by comprising the stages of:

a) Removal of the coarse particle size fraction (e.g., greater than about 210 μm) of the tailing;

b) Desliming the finer fraction obtained in stage a) at about 10 μm, generating a fraction of slurries (overflow) and an underflow;

c) Joining the fraction removed in stage a) with the deslimed fraction greater than about 10 μm obtained in stage b;

d) Conducting acid or basic flotation of the product from stage c).

In one aspect, to be submitted to the concentration process by flotation, the tailing of the current processing circuit, which is derived from the typologies "Tabular Pelite" (PETB), "Pelite Siltite" (PEST), "Detritic" (DETR), "Rich Pelite" (PERC) or "Metallurgical Bioxide" (BXME), the process includes the following general procedures:

Removal of the coarse granulometry fraction (greater than about 210 μm), so that it does not, for example, cause blockages in the cyclones that will carry out the desliming at about 10 μm. The removed material, being very rich in Mn, may be incorporated with the deslimed product to form part of the flotation feed;

Desliming in a cyclone at about 10 μm, generating a fraction of slurries (overflow) and an underflow which may form part of the flotation feed.

In the reverse cationic flotation process of one aspect of the present invention, if a basic flotation is carried out, the initial flotation feed may be composed of 20% of solids. If an acid flotation is carried out, the initial flotation feed may be composed of 50% of solids.

In one aspect, the procedures described above (i.e., sieving 105, cycloning 110, drying 120 and homogenization 125) are carried out in batches, as illustrated in FIG. 1. Adequate modifiers are used in order to improve the reverse cationic flotation selectivity. In one aspect of the reverse cationic flotation process of the present invention, depressor agents and collector agents are used as flotation reagents. In one aspect, the depressor agents are a polysaccharide, for example corn starch, and the cationic collector agents are an amine, for example, amine ether and amide-amine.

In one aspect, the flotation process may be accomplished either in acidic or basic media and one or more flotation stages (which may also be called cleaner stages) may be included in the flotation circuit configuration in order to achieve the desired manganese content in the concentrates.

Because the particles of kaolinite (main mineral of gangue) present a greater degree of liberation than the particles of the manganese minerals, reverse cationic flotation of the gangue is preferable to direct flotation of the ore minerals. Indeed, direct anionic flotation in basic medium of the manganese minerals has not been achieved successfully. In this way, the purpose of the present invention is a process to recover (and concentrate) manganese from the tailing which is based on desliming followed by reverse cationic flotation.

In order to concentrate the tailing from the Azul Mine, for example, (typologies PETB, (PEST), (DETR), (PERC) and (BXME)) it is necessary to submit the materials to a single operation of desliming at about 10 μm, followed by flotation. The overflow constitutes the slurries and is discarded as tailing. The underflow should feed the flotation.

Figure 2:
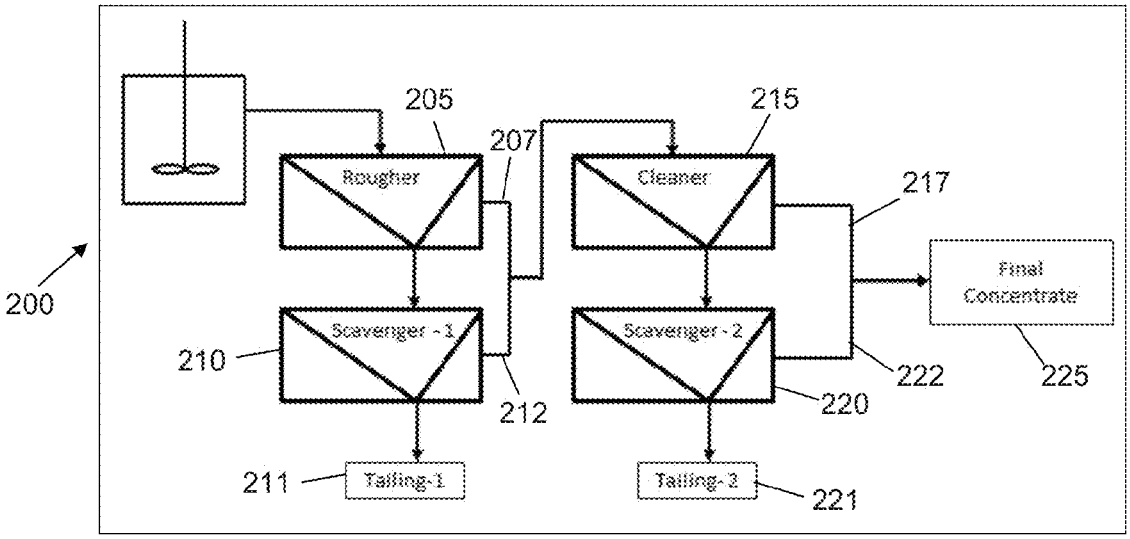
FIG. 2 is a schematic diagram of an aspect of a configuration of a reverse cationic flotation circuit in basic medium.
Figure 3:
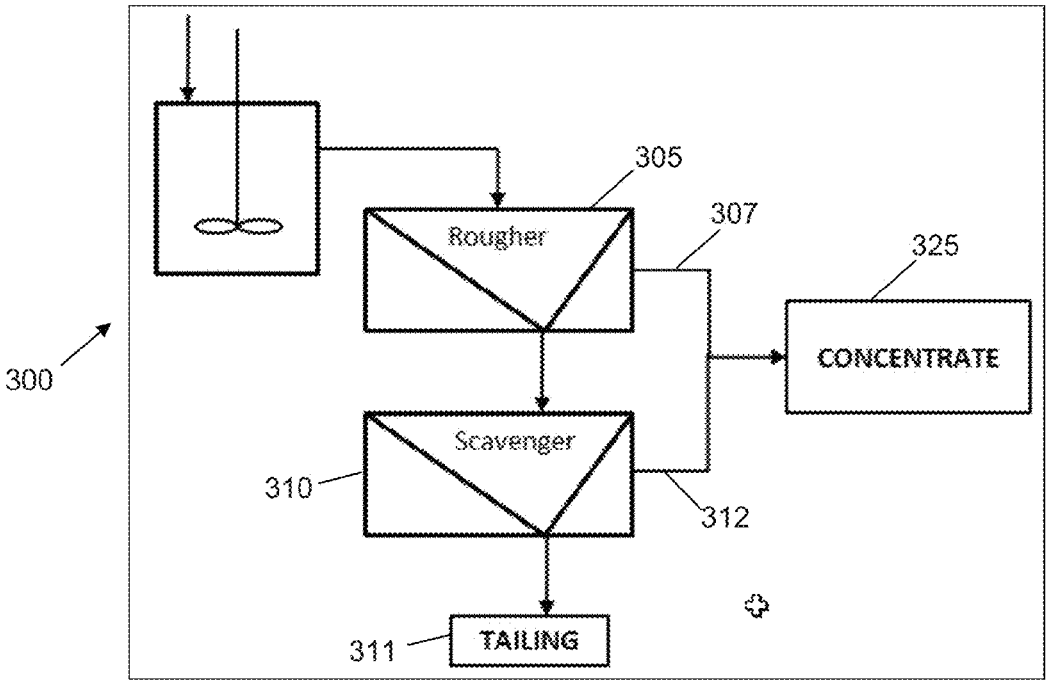
FIG. 3 is schematic diagram of an aspect of a scheme adopted in the flotation assays with PETB.

The reverse cationic flotation of gangue in basic medium of the present invention should be carried out with 20% solids, at a pH between about 10 and about 10.3. Flotation reagents should be used for conditioning in a similar manner as depressors and collectors. FIG. 2 and FIG. 3 show possible arrangements 200, 300 of reverse cationic flotation circuits in basic medium.

Examples of depressors include, but are not limited to, polysaccharides and Amide or the commercial product Fox Head G2241 which act as depressors of manganese minerals in the approximate concentration ranges of about 200-500 mg/L or about 900-2000 g/t.

Examples of collectors include but are not limited to, amines Such as Amine ether (like the commercial product Lilaflot 811M) or amide-amine (like the commercial product Flotigam 5530) which act as collectors for kaolinite, or silicates in general, in the approximate concentration ranges of about 1000-1500 mg/L or about 3900-5900 g/t.

In one aspect, depressors and collectors should be added in this order, being that the conditioning with depressors has to be conducted for at least about 2.5 minutes and the conditioning with collectors has to be conducted for at least about 1 minute.

After conditioning with the flotation reagents described, in one aspect, the rougher flotation 205, 305 should be carried out for 4-5 minutes. The foam produced (rougher tailing) 206 should be mixed with water and submitted to a scavenger stage 210, 310 for about 2-7 minutes, without adding reagents. The foam generated by the scavenger may be considered the tailing 211, 311, whereas in one aspect the sunken product 312 is mixed with the rougher sunken matter 307 and together are considered the concentrate 325, according to FIG. 3.

Nevertheless, at this stage it is possible to realize that the manganese content obtained in the concentrate is still below the expectation, indicating the need of introducing in the process a cleaner stage 215 into the flotation circuit configuration 200. In this aspect, the foam generated by the first scavenger (scavenger-1) 210 is considered to be tailing (Tailing-1) 211, whereas the sunken product 212 is mixed with the rougher sunken matter 207 and together feed a second stage composed of a Cleaner flotation stage 215, followed by a Scavenger-2 stage 220 (according to FIG. 2). In one aspect, the sunken products in the Rougher and Scavenger-1 stages 207, 212 present a concentration of solids of 14-17%.

In this case, the pulp may be conditioned with a depressor in the approximate concentration range of about 90-120 mg/L or about 500-650 g/t and with a collector agent in the approximate concentration range of about 350-500 mg/L or about 2000-2650 g/t at $10<pH<10.3$.

In one aspect, the cleaner flotation is conducted for about 2-4 minutes, producing a foam 216 which feeds the Scavenger-2 stage 220. This is carried out for about 3-6 minutes, without adding reagents. According to FIG. 2, the product floated in the Scavenger-2 stage 220 constitutes Tailing-2 221, whereas the products which sank in the Cleaner and Scavenger-2 stages 217, 222 are mixed and considered to be the final concentrate 225.

Figure 4:
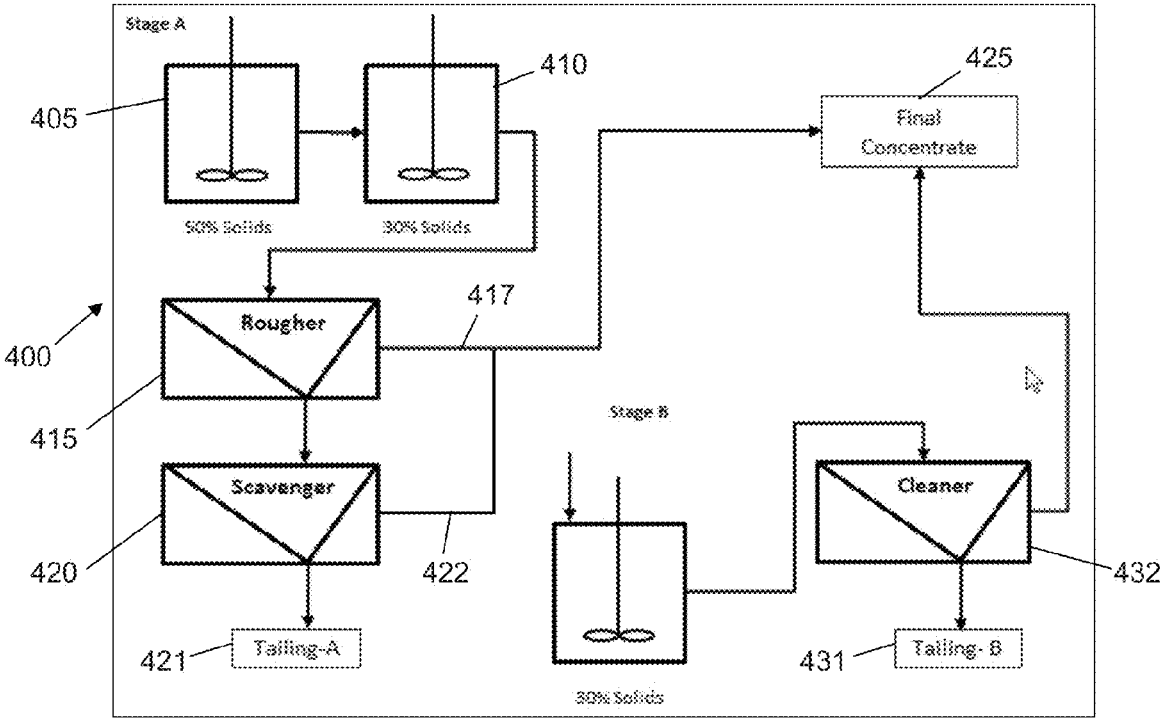
FIG. 4 is a schematic diagram of an aspect of a configuration of a reverse cationic flotation circuit in acid medium.

Alternatively, the reverse cationic flotation in acidic medium 400 according to another aspect of the present invention is conducted in accordance with the scheme illustrated in FIG. 4. In one aspect, optimal results are achieved by preparing the pulp with 50% solids 405, adding $H_2SiF_6$ in an amount to correct the pH up to about 3 and conditioning for at least about 3 minutes. Subsequently, $NaPO_3$ (about 1430 mg/L or about 2000 g/t) is added as a dispersant, followed by conditioning for at least about 2 minutes. After conditioning 405, the pulp is diluted to approximately 30% solids 410, and a dosage of about 3000 g/t (or about 1360 mg/L) of the collector agent is added and conditioning is allowed for at least about 1 minute. The rougher flotation 415 is conducted for at least about 6-7 minutes. The foam produced in the rougher stage 416 is fed to a scavenger stage 420 which is conducted for at least about 10-11 minutes, in the absence of reagents.

Following the scheme illustrated in FIG. 4, in one aspect of the process, the sunken product from the Scavenger stage receives $H_2SiF_6$ to correct the pH to about 3 and conditioning the sunken product mixture for at least about 5 minutes. After this conditioning, in one aspect a collector agent is added to the mixture and conditioned for at least about 1 minute. The cleaner flotation is provided at a pH of about 3.2 for at least about 5 minutes. The foam produced by the cleaner stage is a tailing 421, whereas the sunken product 422 is mixed with the rougher sunken product 417 to form the final concentrate 425.

Importantly, the PETB, PEST, DETR and BXME ores used in the processes of the present invention are predominantly composed of kaolinite which, as well as other clayey minerals, have a notable capacity to alter the rheological properties of the flotation pulp, adversely affecting the mixture of the reagents and influencing the flotation kinetics. Said capacity is less important for the BXME mineral, but is much more relevant for other typologies of the Azul Mine (DETR, PEST and PETB). To solve the problem, the suggestion is to work with more diluted pulps, that is, with a percentage of solids lower than 25%.

It is important to emphasize that the scavenger stage is important with the aim of eliminating the hydrodynamic drag of the fine particles of manganese minerals for the foam produced.

Characterizing the Samples

According to the present invention, before beginning the experiments designed to concentrate the manganese minerals present in the compounds PETB, PEST, DETR, PERC and BXME, a sample was submitted to characterization studies which were carried out at the Technological Characterization Laboratory (LCT) of the Mine Engineering and Petroleum Department at EPUSP. A summary of the most significant information for processing (mineralogy and degree of liberation) is presented. The information refers to the compound PETB, but is analog for other typologies.

Chemical and Mineralogical Composition of the Minerals—PETB

The particle size distribution of the material is displayed in Table 1, where it is possible to note the major occurrence of material with very fine particles, since 45.5% of its mass present particle size lower than 0.010 mm (10 μm), whereas only 3.1% presents a size greater than 0.60 mm.

TABLE 1

Particle Size distribution of the material.

| Particle size | Mass Retained (%) | | Content (%) | |
|---|---|---|---|---|
| fraction (mm) | Simple | Accumulated | Mn | $SiO_2$ |
| +0.589 | 3.1 | 3.1 | 32.9 | 13.0 |
| −0.589 +4.147 | 8.2 | 11.3 | 20.8 | 23.1 |
| −0.147 +0.074 | 6.8 | 18.1 | 14.2 | 27.5 |
| −0.074 +0.037 | 7.7 | 25.8 | 11.4 | 29.2 |
| −0.037 +0.020 | 7.5 | 33.3 | 8.5 | 30.0 |
| −0.020 +0.010 | 21.2 | 54.5 | 4.7 | 35.5 |
| −0.010 | 45.5 | 100.0 | 2.0 | 39.6 |
| Total (calculated) | 100.0 | — | 7.1 | 34.2 |

The following is noted from Table 1:

The fraction retained in the sieve of 28#(opening of 0.589 mm) is highly rich in manganese (32.9%). In fact, the results presented inform that the typical concentrates from the flotation present content in this same range.

The content of $SiO_2$ rises with the decrease of the size of the particles, indicating that the finer fractions are the richest silica-carrying minerals.

As indicated in Table 2, the PETB sample is mostly composed of silica (34.2%) and alumina (29.7%), accompanied by a high content of volatiles (12.5% loss in fire). The content of Mn, however, is only 7.1%, accompanied by 7.3% of Fe and 1.1% of $TiO_2$.

TABLE 2

Chemical composition of the PETB sample.

| | Contents (%) | | | | | | | | |
|---|---|---|---|---|---|---|---|---|---|
| Ore | Mn | Fe | P | $SiO_2$ | $Al_2O_3$ | $TiO_2$ | $K_2O$ | BaO | PF |
| PETB | 7.1 | 7.3 | 0.1 | 34.2 | 29.7 | 1.1 | — | — | 12.5 |

The mineralogical composition (Table 3) corroborates the chemical composition, since the sample in question is mostly made of kaolinite (71% in mass), accompanied by cryptomelane-hollandite (17%), goethite (3.7%) and bixbyite (3.1%).

From the information in Tables 1 and 3 and the characterization report, the following can be noted:

Cryptomelano-hollandite is the predominant manganese-carrying mineral (17% in mass) in the lithology PETB, with prominence also for the presence of manganese in bixbyite (3% in mass) and in lithiophorite (1% in mass), and the initial content of Mn of this lithology can be considered low if compared with other richer lithologies such as Rich Pelite (PERC—content of Mn: 23.3%) or Metallurgical Bioxide (BXME—content of Mn: 24.4%);

The content of manganese decreases considerably in the fraction of fines, with proportions situated between 11 and 33% above 0.037 mm and in the range of 2.0 to 8.5% below 0.037 mm;

The content of $SiO_2$ and $Al_2O_3$ (Kaolinite, main mineral of gangue), presents a different behavior to content of manganese (cryptomelane), maintaining high concentration in all the particle size ranges which were analyzed, with a slight increase in the fine fraction below 0.010 mm.

TABLE 3

Mineralogical composition of the fraction (−0.60 +0.010 mm).

| Minerals | PETB Sample (% in Mass) |
|---|---|
| Crytomelano-hollandite | 17.0% |
| Kaolinite | 71.0% |
| Goethite | 3.7% |
| Bixbyite | 3.1% |
| Ilmenite | 1.8% |
| Lithiophorite | 1.0% |
| Quartz | 0.7% |
| Other | 1.7% |

State of Liberation of the Cryptomelane-Hollandite Particles

Knowledge of the state of liberation of cryptomelane-hollandite particles by particle size range helps to choose the mesh of grinding to be adopted in developing the concentration process, and to predict the relative difficulty in obtaining concentrates with a content of Mn compatible with market specifications. According to the characterization studies of the present invention, the information related to the liberation of the particles of cryptomelane-hollandite which compose the PETB sample is demonstrated in Table 4.

TABLE 4

Liberation of the particles of cryptomelane-hollandite from the lithology PETB by particle size range (−0.60 mm +0.010 mm).

| Total Liberation (%) (*) | Liberation by Particle Size Range (%) | | | | |
|---|---|---|---|---|---|
| | −0.60 mm +0.15 mm | −0.15 mm +0.074 mm | −0.074 mm +0.037 mm | −0.037 mm +0.02000 | −0.020 mm +0.010 mm |
| 45 | 21 | 31 | 39 | 59 | 82 |

(*) −0.60 mm +0.010 mm

Concerning the liberation of the particles of the main manganese mineral (Table 4), importantly:

The degree of total liberation (GL) of the PETB sample is very low (GL=45%). Therefore, it is unrealistic to expect to obtain flotation concentrates with a very high content of Mn;

In the course granulometry fractions (+0.037 mm), GL assumes values below 40%, rising to GL=59% in the range of −0.037 mm+0.020 mm;

The degree of liberation only reaches higher values (GL=82%) in the finer particle size fraction (−0.020 mm+0.010 mm). However, according to common knowledge from the state or the art the flotation of fine particles is not very efficient.

Because the liberation of the main mineral (cryptomelane-hollandite) is deficient, it seems reasonable to make efforts in the reverse flotation of the main mineral of gangue (kaolinite). To carry out reverse flotation of kaolinite, it is necessary to know the degree of liberation (GL) of its particles, in accordance with the results shown in Table 5.

TABLE 5

Liberation of the kaolinite particles from the lithology PETB by particle size range (−0.60 mm +0.010 mm).

| Ore | Total Liberation (%) | Liberation by Particle Size Range (%) | | | | |
|---|---|---|---|---|---|---|
| | | −0.60 mm +0.15 mm | −0.15 mm +0.074 mm | −0.074 mm +0.037 mm | −0.037 mm +0.020 mm | −0.020 mm +0.010 mm |
| PETB | 88 | 68 | 82 | 84 | 90 | 95 |

The results of Table 5 indicate that:

The degree of total liberation of the kaolinite particles is GL=88%. Said value is much higher than that of the main manganese mineral (GL=45%). Therefore, the reverse flotation of kaolinite demonstrates greater success than the direct flotation of the manganese oxides;

In the coarse granulometry fraction (−0.60 mm+0.020 mm), the degree of liberation is in the range of: 68%_GL__90%;

In the finer granulometry fraction (−0.020 mm+0.010 mm), the degree of liberation reaches the amount of GL=95%, but said particle size range is already very near the limits of the flotation process, according to common knowledge from the state or the art.

Preparing the Samples

The tailing from the typology "Tabular Pelite" (PETB) is dried in a stove at 40° C. to withdraw the natural humidity. Once dried, the entire mass is homogenized and subsequently submitted to the preparation flowchart illustrated in FIG. 1. The same procedure is carried out for the compounds PEST, DETR, PERC and BXME.

In accordance with the flowchart of FIG. 1, the entire mass of PETB is classified in a sieve of 65#(opening of 0.21 mm). This procedure is important to avoid blockage of the hydrocyclone on desliming.

Sieving the PETB generates two products:

a) A passing material (undersize) which is submitted to a single operation of desliming in a hydrocyclone (cycloning), seeking a cut at 10 μm;

b) A material withheld in the sieve, which is subsequently mixed to the deslimed product to feed the flotation.

Following the preparation flowchart illustrated in FIG. 1, a single cycloning operation is applied to the undersize of the sieve of 65#(opening of 0.21 mm), generating two products:

a) An underflow, where the coarse particles are concentrated;

b) An overflow, where the slimes are concentrated.

Representative samples of the overflow and underflow from the hydrocyclone, still in pulp form, have their particle size analyzed, for example by laser beam diffraction technique. A summary of the results is displayed in Table 6, where it can be noted that 36% (in volume) of the deslimed product (underflow) corresponds to particles having a size less than 10 μm.

TABLE 6

Particle Size distribution (in volume) of the overflow and underflow from desliming.

| Size of Particles | Underflow | | Overflow (slurries) | |
|---|---|---|---|---|
| | % Simple | % Accumulated | % Simple | % Accumulated |
| +20 μm | 40.9 | 40.9 | 0.0 | 0.0 |
| −20 μm +10 μm | 23.2 | 64.1 | 3.2 | 3.2 |
| −1- μm | 35.9 | 100.0 | 96.8 | 100.0 |
| Total | 100.0 | — | 100.0 | — |

Regarding the particle size distribution of the slimes (Table 12), it is noted that 96.8% of its volume displays a size lower than 10 μm. Continuing the preparation flowchart described in FIG. 1, the material collected in the underflow of the hydrocyclone (deslimed product) is coarse, dried at 40° C., and finally homogenized in an elongated pile jointly with the oversize of the sieve of 65#(opening of 0.21 mm), resulting the composition in a product that has been named "Flotation feed." From this pile of homogenization aliquots of 500 grams are withdrawn which are used in flotation assays.

Particle Size and Chemical Composition from the Flotation Feed—PETB

Particle size and chemical composition of the product called "Flotation feed" are presented in Table 7, where it is noted that 73% of its mass displays a size less than 0.020 mm. Importantly, the flotation process loses efficiency when applied to particle fines. On the other hand, 10% of the mass that feeds the flotation presents a size greater than 0.21 mm. The flotation process is also refractory to the recovery of coarse particles, according to common knowledge from the state or the art. It can be further noted in Table 7 that the manganese is concentrated in the coarse particle size fractions (withheld in 65#), whereby it is possible to calculate an average content of 34.0% of Mn. As the material gets finer, the manganese becomes impoverished and the contents of $SiO_2$ and $Al_2O_3$ become enriched, indicating that the content of kaolinite increases in the finer fractions.

The distribution of the contents (Mn, Fe, P, $SiO_2$, $Al_2O_3$, $TiO_2$, CaO, MgO, $K_2O$, BaO and PF) by particle size range of the product named "Flotation feed" can be found in Table 7, Panels A and B.

TABLE 7

Panel A: Particle size distribution of the "Flotation feed."

| Mesh | Withheld Mass | % Withheld | % Acum. |
|---|---|---|---|
| +28# | 18.18 | 3.66% | 3.66% |
| −28# +65# | 30.42 | 6.12% | 9.78% |
| −65# +100# | 7.91 | 1.59% | 11.37% |
| −100# +150# | 12.43 | 2.50% | 13.87% |
| −150# +200# | 9.10 | 1.83% | 15.70% |
| −200# +325# | 34.78 | 7.00% | 22.70% |
| −325# +400# | 9.52 | 1.92% | 24.61% |
| −400# +635# | 12.52 | 2.52% | 27.13% |
| −635# | 362.17 | 72.87% | 100.00% |
| Total | 497.03 | 100.00% | |

Panel B: distribution and chemical composition of the "Flotation feed".

| | % Contents | | | | Distribution (%) | | | |
|---|---|---|---|---|---|---|---|---|
| Mesh | Mn | Fe | $SiO_2$ | $Al_2O_3$ | Mn | Fe | $SiO_2$ | $Al_2O_3$ |
| +28# | 35.9 | 7.1 | 10.1 | 11.0 | 11.7 | 3.5 | 1.2 | 1.5 |
| −28# +65# | 32.9 | 7.7 | 14.4 | 11.0 | 17.9 | 6.4 | 2.9 | 2.5 |
| −65# +100# | 31.1 | 8.5 | 15.4 | 11.7 | 4.4 | 1.8 | 0.8 | 0.7 |
| −100# +150# | 28.3 | 8.9 | 15.2 | 13.4 | 6.3 | 3.0 | 1.2 | 1.3 |
| −150# +200# | 26.6 | 9.5 | 16.0 | 14.2 | 4.3 | 2.4 | 0.9 | 1.0 |
| −200# +325# | 20.4 | 9.5 | 20.7 | 19.7 | 12.7 | 9.1 | 4.7 | 5.1 |
| −325# +400# | 23.5 | 10.3 | 17.5 | 16.6 | 4.0 | 2.7 | 1.1 | 1.2 |
| −400# +635# | 17.6 | 9.9 | 22.3 | 20.0 | 3.9 | 3.4 | 1.8 | 1.9 |
| −635# | 5.4 | 6.8 | 36.2 | 31.3 | 34.7 | 67.6 | 85.4 | 84.9 |
| Total | 11.2 | 7.3 | 30.9 | 26.9 | 100.0 | 100.0 | 100.0 | 100.0 |

Concerning the distribution of the manganese in the "Flotation feed" (Table 7, Panel B), it is noted that:

a) 35% of the manganese is concentrated in the finest fraction, that is, that which passes through the sieve of 635# (opening of 0.020 mm);

b) 30% of the manganese is concentrated in the coarse fraction, that is, that which is withheld in the mesh of 65# (opening of 0.21 mm);

c) 35% of the manganese is distributed among the intermediate particle size fractions, that is, between 0.21 mm and 0.020 mm.

Regarding the distribution of silica and alumina in the "Flotation feed" (Table 7, Panel B), it is noted that 85% of the silica, and also of the alumina, is concentrated in the finest fraction (size less than 0.020 mm), and the remaining 15% is distributed along the other particle size classes. Said behavior constitutes an indication of the distribution of the main mineral of gangue, kaolinite.

The density of the material named "Flotation feed" was determined in triplicate by pycnometry, resulting in a value of (2.51±0.01) g/cm$^3$. Said low density is evidence of the predominance of the mineral kaolinite in the composition of this material.

The following examples simply help illustrate the present invention and are not by any means limiting of its scope.

EXAMPLE 1

Flotation for "Tabular Pelite" (PETB) in Basic Medium

In order to concentrate the tailing from the Azul Mine (typology PETB) the material is formerly submitted to an operation of desliming at 10 μm, followed by flotation. The overflow constitutes the slurries and is discarded as tailing. The underflow feeds the flotation.

The reverse cationic flotation of gangue in basic medium is carried out with 20% solids, at 10<pH<10.3, after conditioning with flotation reagents: depressor (corn starch) and cationic collector, added in this order, after 2.5 minutes of conditioning with depressor and 1 minute of conditioning with cationic collector. Amide or Fox Head G2241 act as depressors of manganese minerals in the concentration of 227 mg/L or 900 g/t, whereas amine ether (Lilaflot 811M) or amide-amine (Flotigam 5530) act as collectors for kaolinite in the concentration of 1360 mg/L or 5333 g/t. After conditioning with the flotation reagents, the rougher flotation is carried out for 5-6 minutes. The foam produced (rougher tailing) 206 is mixed with water and submitted to a scavenger-1 210 stage for 6 minutes, without adding reagents.

The foam generated by the scavenger-1 210 is considered to be tailing (Tailing-1) 211, whereas the sunken product 212 is mixed with the rougher sunken matter 207 and together feed a second stage composed of a cleaner flotation stage 215, followed by a scavenger-2 stage 220.

The products sunken in the rougher and scavenger-1 stages 205, 210 present a concentration of solids of 14-17%. Said pulp is then conditioned with a depressor agent (amide or Fox Head) in a concentration of about 90 mg/L or about 500 g/t and with a cationic collector (Flotigam 5530 or Lilaflot 811M) in the concentration of about 364 mg/L or about 2030 g/t at 10<pH<10.3. The cleaner flotation is conducted for 6 minutes, producing a foam 216 which feeds the Scavenger-2 stage 220. This is carried out for 4 minutes, without adding reagents. According to FIG. 2, the product floated in the Scavenger-2 stage 220 constitutes Tailing-2 221, whereas the products which sank in the Cleaner and Scavenger-2 stages 217, 222 are mixed and considered to be the final concentrate 225.

Figure 5A:
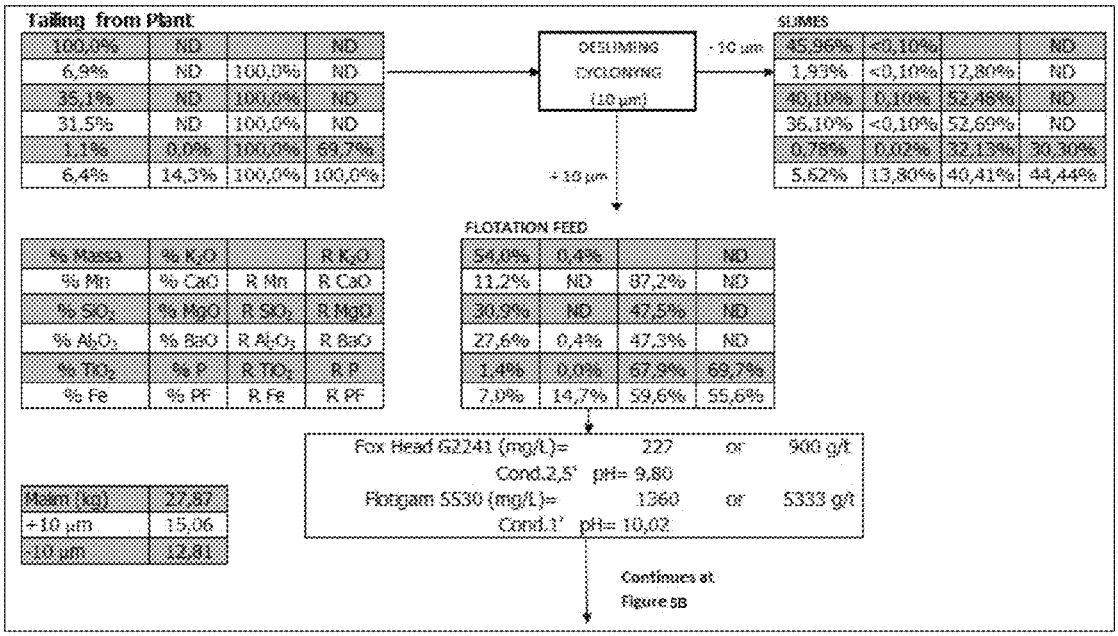
FIGS. 5A, 5B and 5C (panels A, B and C, respectively) are schematic diagrams of an aspect of a global metallurgical balance of the reverse cationic flotation in basic medium.
Figure 5B:
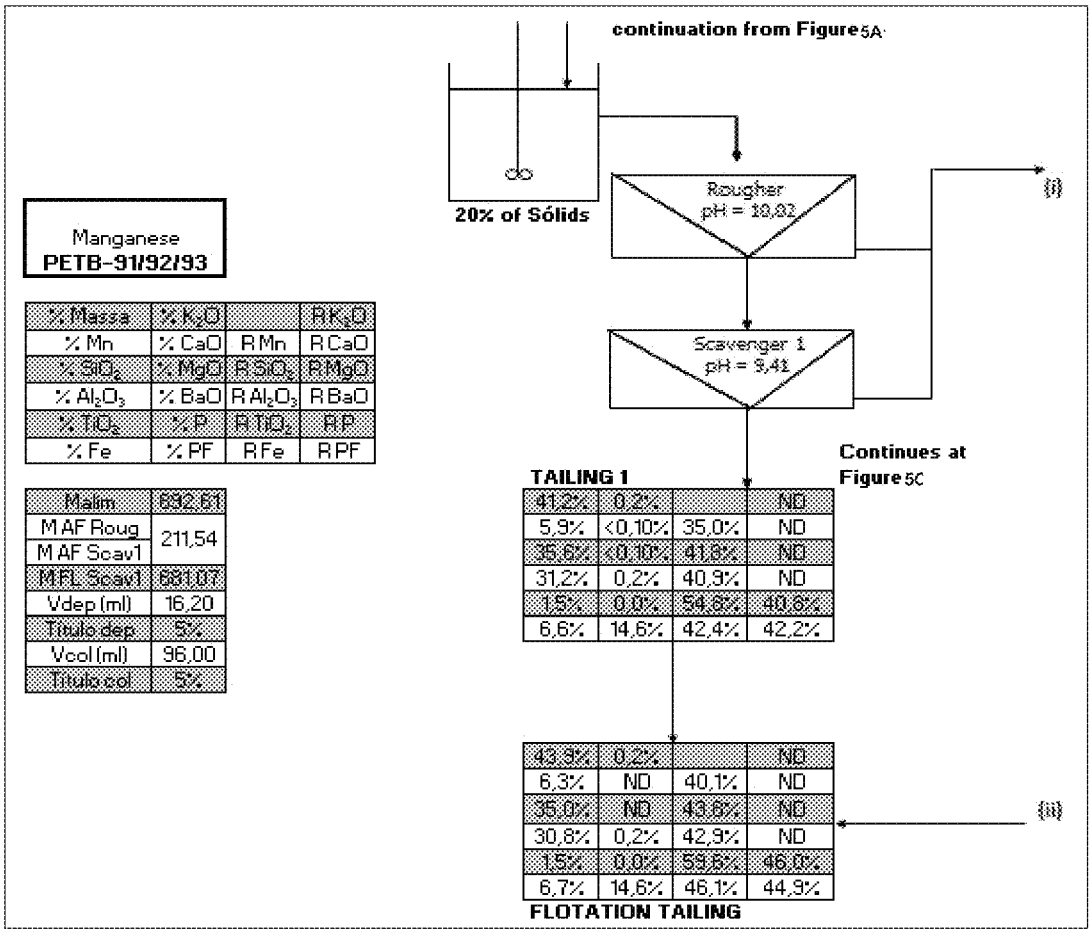
Figure 5C:
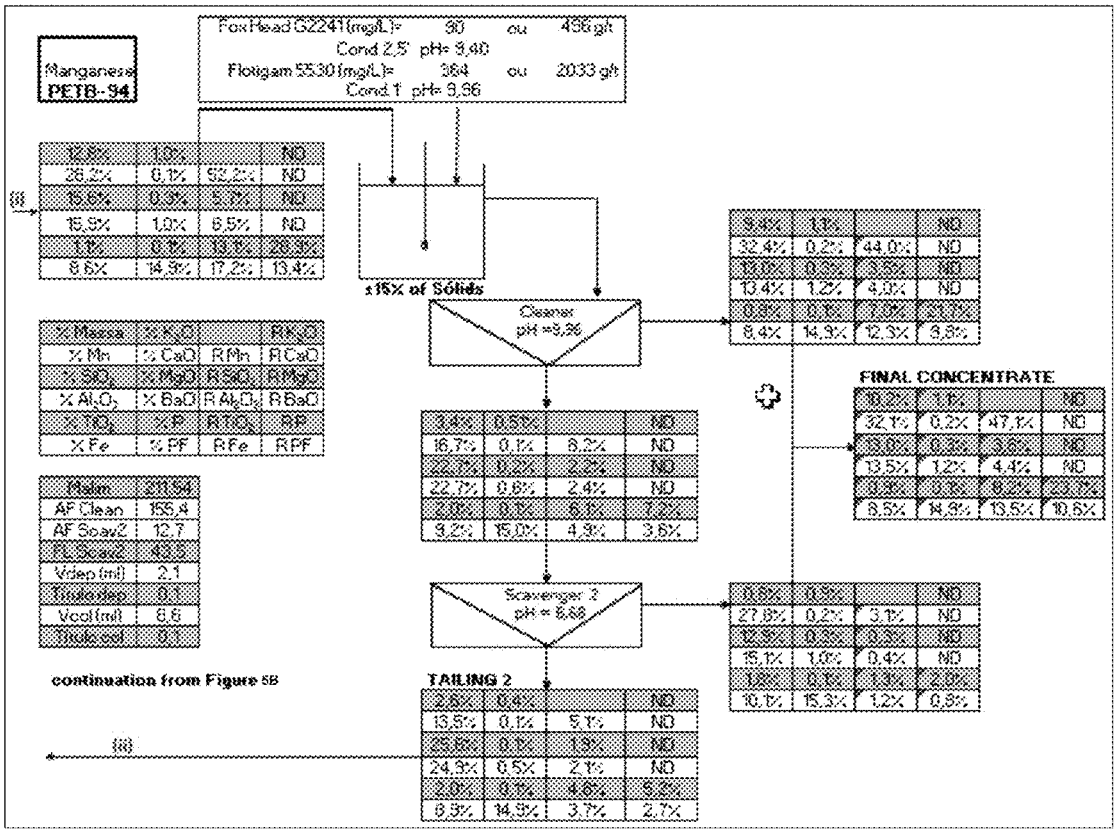

The global metallurgical balance of the concentration process based on desliming followed by reverse cationic flotation in basic medium is summarized in Table 8 and illustrated in FIGS. 5A-5C (panels A, B and C).

TABLE 8

Metallurgical balance of the process comprised of desliming + flotation in basic medium

| | Contents (%) | | Mass partition (%) | | |
|---|---|---|---|---|---|
| Products | Mn | $SiO_2$ | Mass | Mn | $SiO_2$ |
| Slurries | 11.2 | 30.9 | 46.0 | 12.8 | 52.5 |
| Flotation tailing | 6.3 | 35.0 | 43.8 | 40.1 | 43.7 |
| Concentrate | 32.1 | 13.0 | 10.2 | 47.1 | 3.8 |
| Feed (calculated) | 6.9 | 35.1 | 100.0 | 100.0 | 100.0 |

EXAMPLE 2

Flotation for "Tabular Pelite" (PETB) in Acid Medium

Reverse cationic flotation in acidic medium is conducted in accordance with the scheme 400 illustrated in FIG. 4. Optimum results are obtained by preparing the pulp with 50% solids 405, adding $H_2SiF_6$ to correct the pH=3 (930 mg/L or 1116 g/t), conditioning for 3 minutes, after which, $NaPO_3$ (1430 mg/L or 2000 g/t) is added as dispersant, followed by conditioning for 2 minutes. After conditioning, the pulp is diluted to 31% solids, at the dosage of 3000 g/t (or 1360 mg/L) is added of the collector Flotigam 5530 which is conditioned for 1 minute. The Rougher flotation 415 is conducted for 6-7 minutes. The foam 416 produced in the Rougher stage 415 is fed to a Scavenger stage 420 which is conducted for 10-11 minutes, in the absence of reagents.

Figure 6:
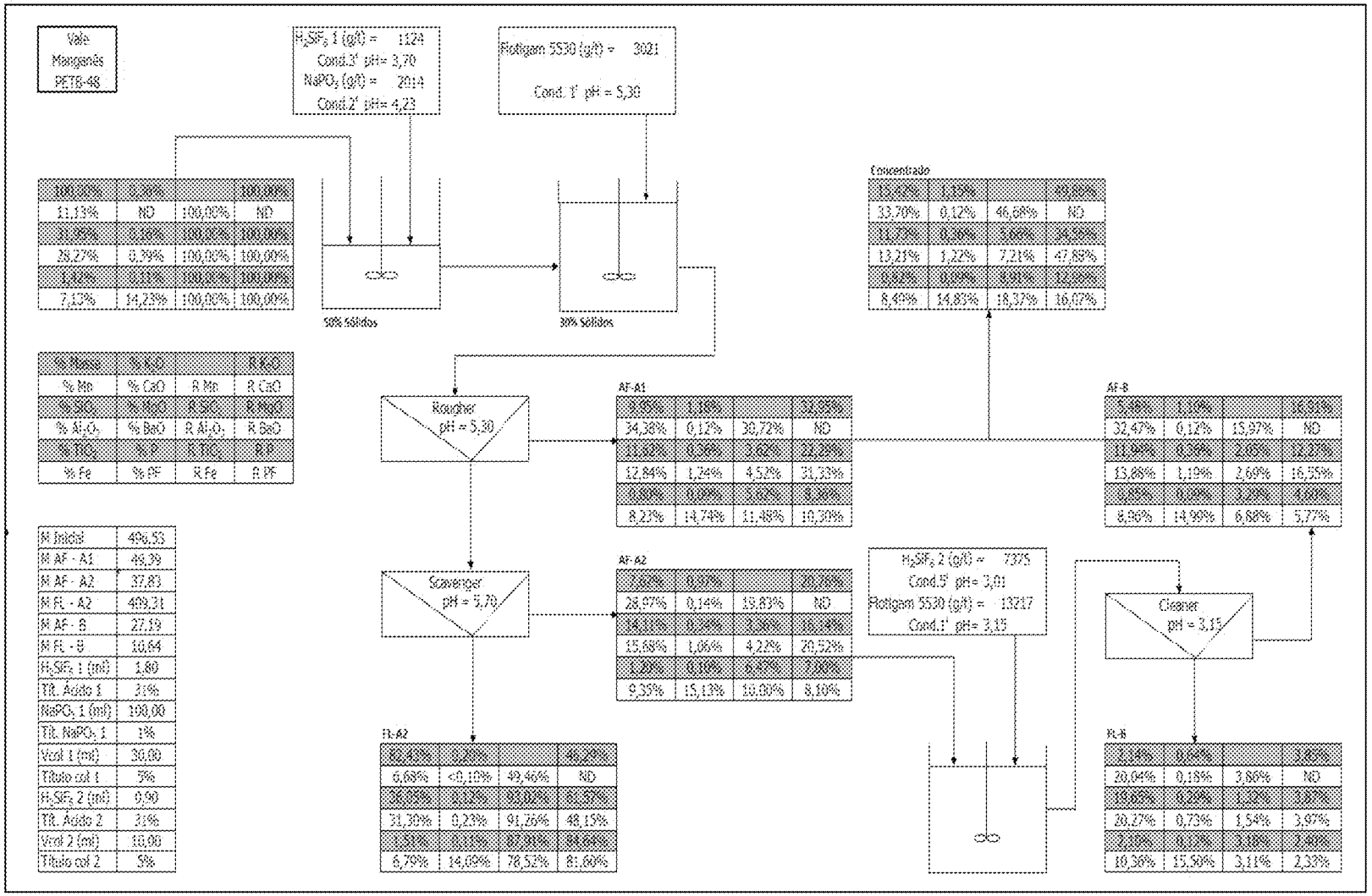
FIG. 6 is a schematic diagram of a metallurgical balance of one aspect of the reverse cationic flotation in acid medium.

Following the scheme 400 illustrated in FIG. 4, the sunken product from the Scavenger stage receives $H_2SiF_6$ (255 mg/L) to correct the pH to about 3, conditioning it for 5 minutes. After this conditioning, Flotigam 5530 (455 mg/L) is added and conditioned for 1 minute. The cleaner flotation 430 is conducted at pH=3.2 for 5 minutes. The foam 431 produced by the Cleaner stage 430 is considered to be a tailing 431, whereas the sunken product 432 is mixed with the rougher sunken product 417 to compose the final concentrate 425. The metallurgical balance of the concentration process comprised of desliming and reverse cationic flotation in acid medium is presented in Table 9 and illustrated in FIG. 6.

TABLE 9

Metallurgical balance of the process comprised of desliming + flotation in acid medium

| | Contents (%) | | Mass partition (%) | | |
|---|---|---|---|---|---|
| Products | Mn | $SiO_2$ | Mass | Mn | $SiO_2$ |
| Slurries | 11.2 | 30.9 | 46.0 | 12.8 | 51.6 |
| Flotation tailing | 7.0 | 35.6 | 45.7 | 46.5 | 45.7 |
| Concentrate | 33.7 | 11.7 | 8.3 | 40.7 | 2.7 |
| Feed (calculated) | 6.9 | 35.7 | 100.0 | 100.0 | 100.0 |

EXAMPLE 3

Flotation for "Pelite Siltite" (PEST) in Basic Medium

To be submitted to the concentration process by flotation, the tailing of processing circuits derived from the typology "Pelite Siltite" (PEST) also requires the procedures of removal of the coarse granulometry fraction and desliming, according to the general procedure. The same concentration route adopted for typologies as PETB is followed, being carried out reverse cationic flotation of the silicates in basic medium (10.0<pH<10.3).

The reverse cationic flotation of the gangue in basic medium is carried out with 20% solids, at 10<pH<10.3, after conditioning with flotation reagents: depressor (corn starch) and cationic collector, which are added in this order, after 2.5 minutes of conditioning with depressor and 1 minute of conditioning with collector. Amide or Fox Head G2241 act as depressors of manganese minerals in the concentration of 230 mg/L or 900 g/t, whereas amide-amine (Flotigam 5530) act as collector for kaolinite in the concentration of 1360 mg/L or 5333 g/t. After conditioning with the flotation reagents described, the rougher flotation is carried out for 3.5 minutes. The foam produced (rougher tailing) is mixed with water and submitted to a scavenger stage for 7-8 minutes, without adding reagents. The foam generated by the scavenger is considered to be tailing, whereas the sunken product is mixed to the rougher sunken matter and together are considered to be concentrate.

The flowchart of the concentration process is illustrated in FIG. 3. It is comprised by reverse cationic flotation in basic medium. Its metallurgical balance is summarized in Table 10, where it is noted that it is possible to obtain a concentrate containing 39% Mn and overall metallurgical recovery of 50%. The flotation tailing constitutes the main loss of Mn (34%) which can be justified by the deficient liberation of the Mn minerals. In the slurries, only 17% is lost.

TABLE 10

Metallurgical balance of the process comprised of desliming + flotation in basic medium

| Products | Contents (%) Mn | Contents (%) $SiO_2$ | Mass partition (%) Mass | Mass partition (%) Mn | Mass partition (%) $SiO_2$ |
|---|---|---|---|---|---|
| Slurries | 6.5 | 35.7 | 42.2 | 16.7 | 56.5 |
| Flotation tailing | 15.0 | 27.8 | 36.9 | 33.7 | 38.4 |
| Concentrate | 39.0 | 6.5 | 20.9 | 49.6 | 5.1 |
| Feed (calculated) | 16.4 | 26.7 | 100.0 | 100.0 | 100.0 |

Figure 7:
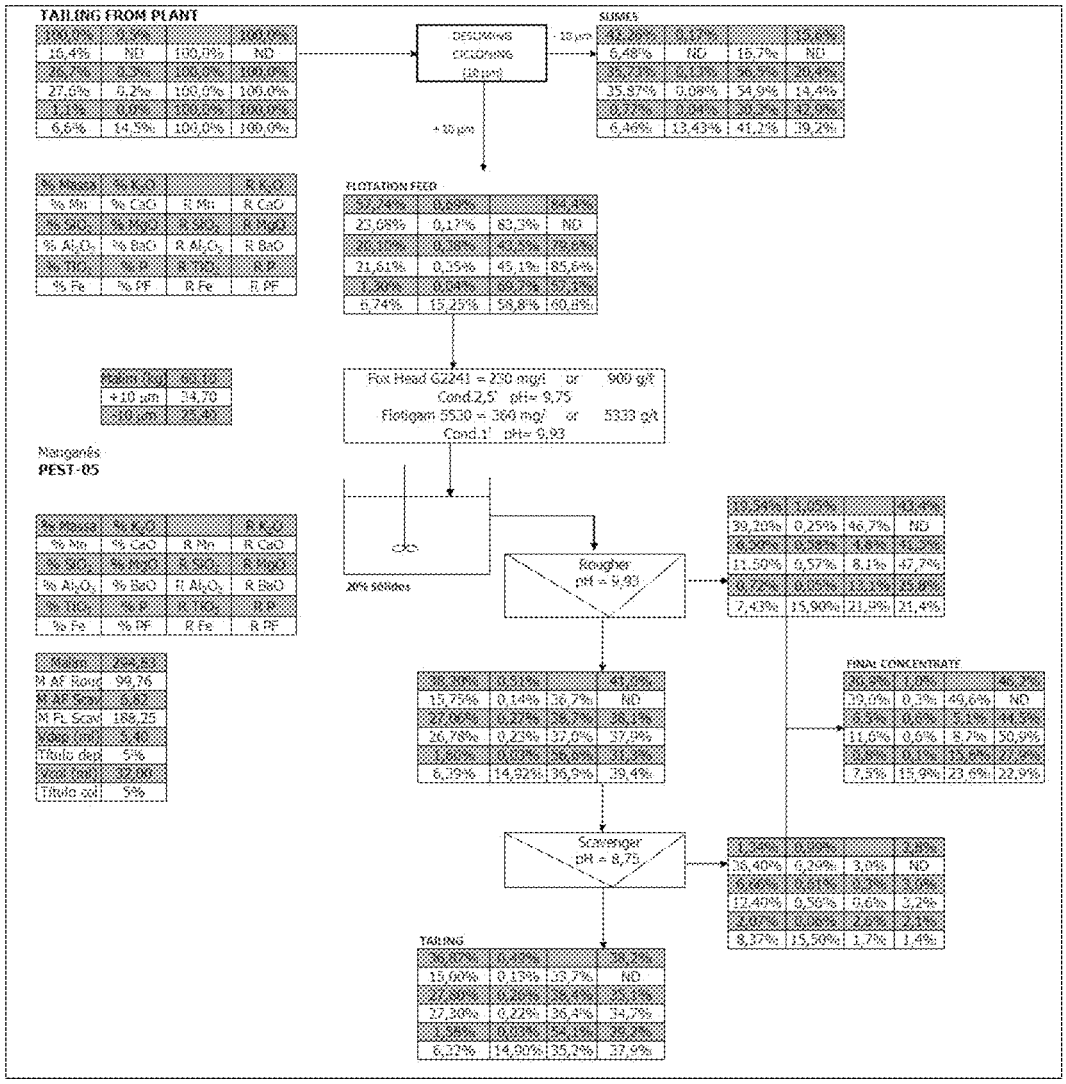
FIG. 7 is a schematic diagram of a global metallurgical balance of one aspect of the concentration process based on desliming followed by reverse cationic flotation in basic medium.

FIG. 7 shows the global metallurgical balance of the reverse cationic flotation for PEST in basic medium.

EXAMPLE 4

Flotation for "Detritic" (DETR) in Basic Medium

To be submitted to the concentration process by flotation, the tailing of processing circuits derived from the typology "Detritic" (DETR) also requires the procedures of removal of the coarse granulometry fraction and desliming, according to the former procedures. The same concentration route adopted for typologies PETB and PEST is followed, being carried out with reverse cationic flotation of the silicates in basic medium (10.0<pH<10.3).

To concentrate the tailing from washing the Azul Mine (typology DETR) it is necessary to submit the material to an operation of desliming at 10 μm, followed by flotation. The overflow constitutes the slurries and is discarded as tailing. The underflow feed the flotation.

Figure 8:
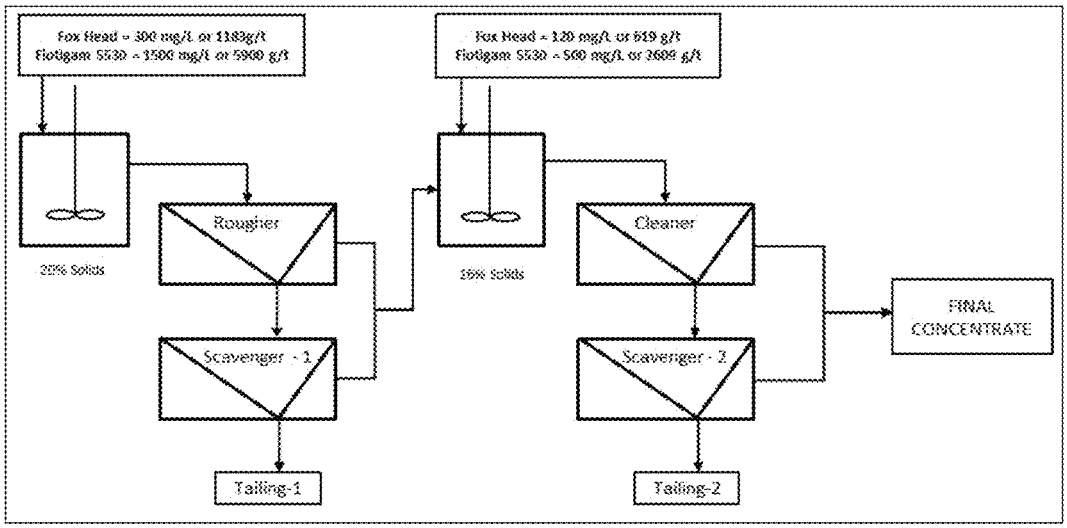
FIG. 8 is a schematic diagram of a configuration of a reverse cationic flotation circuit in basic medium.

Following the same strategy adopted for concentrating the other lithologies from the Azul mine, the reverse cationic flotation of the gangue (silicates) in basic medium is carried out with 20% solids, at 10<pH<10.3, after conditioning with flotation reagents: depressor (corn starch) and cationic collector, which are added in this order, after 2.5 minutes of conditioning with depressor and 1 minute of conditioning with collector. Corn starch (Fox Head G2241) act as depressor of manganese minerals, in the concentration of 300 mg/L (or 1183 g/t), whereas amide-amine (Flotigam 5530) act as collector for silicates, in the concentration of 1500 mg/L (or 5900 g/t). After conditioning with the flotation reagents described, the rougher flotation is carried out for 5.0 minutes. The foam produced (rougher tailing) is mixed with water and submitted to a scavenger stage for 5.5 minutes, without adding reagents. The foam generated by the scavenger is considered to be tailing (tailing-1, whereas the sunken product is mixed to the rougher sunken matter and together feed a second stage composed of a cleaner flotation stage, followed by a scavenger-2 stage (see FIG. 8).

The products sunken in the rougher and scavenger-1 stages present a concentration of solids of about 16%. Said pulp is conditioned with depressor (Fox Head G2241) in the concentration of about 120 mg/L or about 619 g/t and with collector (Flotigam 5530) in the concentration of about 500 mg/L or about 2609 g/t at 10<pH<10.3. The cleaner flotation is conducted for 3.5 minutes, producing a foam which is fed to the scavenger-2 stage. This is carried out for 2.8 minutes, without adding reagents. According to FIG. 8, the product floated in the scavenger-2 stage constitutes the tailing-2, whereas the products which sank in the cleaner and scavenger-2 stages are mixed and considered to be the final concentrate; the global metallurgical balance for processing the DETR typology is presented in Table 11 where it can be noted that:

By conducting the flotation in accordance with Example 4 it is possible to generate a concentrate with 22.3% of Mn and 21.2% of $SiO_2$;

The overall recovery of Mn from the process is 52.0%, and 14.9% is lost in desliming and 33.1% in tailing from the flotation process.

TABLE 11

Metallurgical balance of the process comprised of desliming + flotation in basic medium for typology DETR

| Products | Contents (%) Mn | Contents (%) $SiO_2$ | Mass partition (%) Mass | Mass partition (%) Mn | Mass partition (%) $SiO_2$ |
|---|---|---|---|---|---|
| Slurries | 1.4 | 39.4 | 45.9 | 14.9 | 49.5 |
| Flotation tailing | 3.3 | 37.2 | 43.9 | 33.1 | 44.6 |
| Concentrate | 22.3 | 21.2 | 10.2 | 52.0 | 5.9 |
| Feed (calculated) | 4.4 | 36.6 | 100.0 | 100.0 | 100.0 |

EXAMPLE 5

Flotation for "Rich Pelite" (PERC) in Basic Medium

To be submitted to the concentration process by flotation, the tailing of processing circuits derived from the typology "Rich Pelite" (PERC) also requires the procedures of removal of the coarse granulometry fraction and desliming, according to the former procedures. The same concentration route adopted for typologies as PETB and PEST is followed, being carried out reverse cationic flotation of the silicates in basic medium (10.0<pH<10.3).

To concentrate the tailing from washing of the Azul Mine (typology PERC), the material is submitted to a single operation of desliming at 10 μm, followed by flotation. The overflow constitutes the slurries and is discarded as tailing. The underflow is fed to the flotation process.

Following the same concentration route adopted for other typologies of the Azul Mine (PETB and PEST), the reverse cationic flotation of the gangue in basic medium is carried out with 20% solids, at 10<pH<10.3, after conditioning with flotation reagents: depressor (polysaccharides) and collector (fatty amines), which are added in this order, after 2.5 minutes of conditioning with depressor and 1 minute of conditioning with collector.

Following the same reasoning adopted for former processes, corn starch (Fox Head G2241) act as depressors of manganese minerals in the concentration of 300 mg/L (or 1183 g/t), whereas amide-amine (Flotigam 5530) act as collector for silicates in the concentration of 1200 mg/L (or 4717 g/t). After conditioning with the flotation reagents described, the rougher flotation is carried out for 3.4 minutes. The foam produced (tailing rougher) is mixed with water and submitted to a scavenger stage for 3.2 minutes, without adding reagents. The foam generated by the scavenger is considered to be tailing, whereas the sunken product is mixed to the rougher sunken matter and together are considered to be concentrate (FIG. 3).

The overall metallurgical balance for processing the typology PERC is presented in Table 12 where it can be noted that:

By conducting the flotation in accordance with the experiment conditions of Example 5, it is possible to generate a concentrate with 48.21% of Mn and 8.65% of SiO2;

The overall recovery of Mn from the process is 63.9%, and 14.0% is lost in desliming and 22.1% in tailing from the flotation.

TABLE 12

Metallurgical balance of the process comprised of desliming + flotation in basic medium for typology PERC

| Products | Contents (%) | | Mass partition (%) | | |
|---|---|---|---|---|---|
| | Mn | $SiO_2$ | Mass | Mn | $SiO_2$ |
| Slurries | 10.18 | 36.46 | 33.1 | 14.0 | 40.5 |
| Flotation tailing | 15.30 | 43.10 | 34.9 | 22.1 | 50.3 |
| Concentrate | 48.21 | 8.65 | 32.0 | 63.9 | 9.2 |
| Feed (calculated) | 24.12 | 29.88 | 100.0 | 100.0 | 100.0 |

EXAMPLE 6

Flotation for "Metallurgical Bioxide" (BXME)

To be submitted to the concentration process by flotation, the tailing of processing circuits derived from the typology "Metallurgical Bioxide" (BXME) also requires the procedures of removal of the coarse granulometry fraction and desliming, according to the former procedures. The same concentration route adopted for typologies PETB and PEST is also followed, being carried out using reverse cationic flotation of the silicates in basic medium (10.0<pH<10.3). These procedures are carried out in batches, in accordance with that illustrated in the flowchart of FIG. 1.

The reverse cationic flotation of the gangue in basic medium is carried out with 20% solids, at 10<pH<10.3, after conditioning with flotation reagents: depressor (polysaccharides) and collector (fatty amines), which are added in this order, after 2.5 minutes of conditioning with depressor and 1 minute of conditioning with collector. Following the same reasoning adopted for PETB and PEST, polysaccharides (Fox Head G2241) act as depressors of manganese minerals in the concentration of 500 mg/L (or 1967 g/t), whereas amide-amine (Flotigam 5530) act as collector for silicates in the concentration of 1000 mg/L (or 3933 g/t).

After conditioning with the flotation reagents described, the rougher flotation is carried out for 6.0 minutes. The foam produced (rougher tailing) is mixed with water and submitted to a scavenger stage for 4.8 minutes, without adding reagents. The foam generated by the scavenger is considered to be tailing, whereas the sunken product is mixed to the rougher sunken matter and together are considered to be concentrate (see FIG. 3).

The global metallurgical balance for processing the typology BXME is presented in Table 13 where it can be noted that:

By conducting the flotation in accordance with the experiment conditions of example 6, it is possible to generate a concentrate with 47.99% of Mn and 5.03% of $SiO_2$;

The overall possible recovery from the process is 46.7%, and 15.80% is lost on desliming and 37.5% in tailing from the flotation.

TABLE 13

Metallurgical balance of the process comprised of desliming + flotation in basic medium for typology BXME

| Products | Contents (%) | | Mass partition (%) | | |
|---|---|---|---|---|---|
| | Mn | $SiO_2$ | Mass | Mn | $SiO_2$ |
| Slurries | 12.44 | 30.22 | 32.2 | 15.8 | 43.6 |
| Flotation tailing | 22.10 | 26.3 | 43.1 | 37.5 | 50.8 |
| Concentrate | 47.99 | 5.03 | 24.7 | 46.7 | 5.6 |
| Feed (calculated) | 25.3 | 22.3 | 100.0 | 100.0 | 100.0 |

The above six examples of various aspects of the present invention are merely illustrative. The scope of protection conferred by the present invention encompasses all other alternative forms appropriate for the implementation of the invention.

The invention claimed is:

1. A process for concentrating manganese from a tailing of a manganese-carrying mineral from a beneficiation plant, the process comprising:

removing a coarse particle size fraction from the tailing, wherein the coarse particle size is greater than about 210 μm;

desliming a fine particle size fraction from the tailing, wherein the fine particle size is about 10 μm, and generating an overflow fraction of slurries and an underflow;

combining the removed coarse particle size fraction with the deslimed fine particle size fraction to form a mixture; and performing an acidic flotation or performing a basic flotation of the mixture.

2. The process according to claim 1, wherein the manganese-carrying mineral comprises a low manganese content.

3. The process according to claim 1, wherein the manganese-carrying mineral is from a lithology selected from the group consisting of "Tabular Pelite" (or PETB), Pelite Siltite (or PEST), Detritic (or DETR), Rich Pelite (or PERC) and Metallurgical Bioxide (or BXME).

4. The process according to claim 1 wherein the performing of the acidic flotation or the performing of the basic flotation comprises performing a reverse cationic flotation.

5. The process according to claim 1 comprising performing the basic flotation with an initial flotation feed comprising 20% solids.

6. The process according to claim 1 wherein the performing the acidic flotation comprises performing an initial flotation feed comprising 50% solids.

7. The process according to claim 4 comprising performing the reverse cationic flotation using a depressor agent and a collector agent as flotation reagents.

8. The process according to claim 4 comprising performing one or more cleaner steps.

9. The process according to claim 7 wherein the depressor agent is a polysaccharide and the collector agent is an amine.

10. The process according to claim 9 wherein the depressor agent is corn starch.

11. The process according to claim 9 wherein the cationic collector agent is selected from the group consisting of amine ether and amide-amine.

* * * * *